US009822739B2

(12) United States Patent
Oda et al.

(10) Patent No.: US 9,822,739 B2
(45) Date of Patent: Nov. 21, 2017

(54) VEHICLE WITH AN EGR-COOLER AND ITS DIAGNOTIC

(71) Applicant: Toyota Jidosha Kabushiki Kaisha, Toyota-shi Aichi-ken (JP)

(72) Inventors: Yoshihisa Oda, Toyota (JP); Toshitake Sasaki, Toyota (JP); Kenji Kimura, Toyota (JP); Kazuya Miyaji, Okazaki (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 15/112,024

(22) PCT Filed: Nov. 12, 2014

(86) PCT No.: PCT/JP2014/005674

§ 371 (c)(1),
(2) Date: Jul. 15, 2016

(87) PCT Pub. No.: WO2015/107580

PCT Pub. Date: Jul. 23, 2015

(65) Prior Publication Data

US 2016/0348616 A1 Dec. 1, 2016

(30) Foreign Application Priority Data

Jan. 15, 2014 (JP) ..... 2014-004899

(51) Int. Cl.
*F02M 25/07* (2006.01)
*F02M 26/49* (2016.01)
(Continued)

(52) U.S. Cl.
CPC ..... *F02M 26/49* (2016.02); *F02M 26/22* (2016.02); *F02M 26/47* (2016.02)

(58) Field of Classification Search
CPC ..... F02M 26/24; F02M 26/22; F02M 26/47; F02M 26/49
See application file for complete search history.

(56) References Cited

U.S. PATENT DOCUMENTS 8,938,964 B2 * 1/2015 Kanou ..... F01K 7/22 123/568.11
2012/0290190 A1 11/2012 Kim et al.
2015/0345432 A1 * 12/2015 De La Morena ..... F02M 26/24 701/102

FOREIGN PATENT DOCUMENTS

FR 2921432 A1 3/2009
JP 2007-092718 A 4/2007
(Continued)

*Primary Examiner* — Hieu T Vo
(74) *Attorney, Agent, or Firm* — Dinsmore & Shohl LLP

(57) ABSTRACT

In a vehicle provided with an engine, an EGR cooler for cooling EGR gas recirculated from an exhaust channel of the engine to an intake channel thereof by using a coolant, an electric pump for supplying the coolant to the EGR cooler, and a gas temperature sensor for detecting the temperature of the EGR gas temperature at the downstream of the EGR cooler, an ECU acquires a first gas temperature in a normally stable state where the electric pump is rotating, thereafter performs a coolant amount suppressing process to suppress the rotational speed of the electric pump, acquires a second gas temperature in a suppressed stable state after a predefined time has elapsed from the start of the coolant amount suppressing process, and determines that the EGR cooler is abnormal if a difference between the first gas temperature and the second gas temperature is less than a threshold value.

6 Claims, 4 Drawing Sheets

(51) Int. Cl.
*F02M 26/22* (2016.01)
*F02M 26/47* (2016.01)

(56) References Cited

FOREIGN PATENT DOCUMENTS

| | | | |
|---|---|---|---|
| JP | 2008-261297 | A | 10/2008 |
| JP | 2010-138788 | A | 6/2010 |
| JP | 2010-270669 | A | 12/2010 |
| JP | 2011-132852 | A | 7/2011 |

* cited by examiner

[Fig. 5]

VEHICLE WITH AN EGR-COOLER AND ITS DIAGNOTIC

TECHNICAL FIELD

The present disclosure relates to a vehicle, and in particular relates to a vehicle provided with an engine having a cooling device for cooling exhaust gas recirculated to an intake channel (hereinafter referred to as "EGR (Exhaust Gas Circulation) gas").

BACKGROUND ART

Typically, an engine having an exhaust gas recirculation device is provided a device for cooling the EGR gas by a coolant (hereinafter referred to as "EGR cooler"). In the case where soot or the like in the EGR gas deposits inside the EGR gas channel, the cooling capacity (heat exchange efficiency between the EGR gas and the coolant inside the EGR cooler) of the EGR cooler is decreased. In the case where the cooling capacity of the EGR cooler is decreased, the EGR gas is recirculated to the intake channel while being hot, the intake channel may be damaged by overheating. Therefore, it is desired to detect a reduction in the cooling capacity of the EGR cooler and notify the same to a user.

Japanese Patent Laying-Open No. 2008-261297 (PTL 1) discloses a technique which determines that in a structure configured to supply a coolant to an EGR cooler by using a mechanical water pump driven by the power of an engine, the cooler is abnormal if the temperature of the EGR gas is higher than the temperature of the coolant by a predefined value or more, and determines that the cooling capacity of the EGR cooler is decreased if the abnormality determination count is not less than a first predefined value when the engine is rotating at a low rotational speed and the abnormality determination count is not less than a second predefined value when the engine is rotating at a high rotational speed.

CITATION LIST

Patent Literature patcit 1: Japanese Patent Laying-Open No. 2008-261297

SUMMARY

Technical Problem

In the case where using the technique disclosed in PTL 1 to determine whether or not the cooling capacity of the EGR cooler is decreased, it is necessary to know both the abnormality determination count when the engine is rotating at a low rotational speed and the abnormality determination count when the engine is rotating at a high rotational speed. However, depending on the request of a user or the state of the vehicle, the engine may not be maintained at a low rotational state or may not be maintained at a high rotational state. Thereby, it may not be able to properly determine whether or not an abnormality (a reduction in cooling capacity) is present in the EGR cooler.

The present disclosure has been accomplished in view of the aforementioned problems, and it is therefore an object of the present disclosure to properly determine whether or not an abnormality is present in the EGR cooler.

Solution to Problem (1) According to the present disclosure, a vehicle provided with an engine having a recirculation channel for recirculating a part of exhaust gas flowing in an exhaust channel to an intake channel includes a cooling device, in contact with the recirculation channel, for cooling the recirculated gas in the recirculation channel by using a coolant, an electric pump for supplying the coolant to the cooling device, a temperature sensor for detecting a temperature of the recirculated gas in the recirculation channel at the downstream of the cooling device, and a control device for determining whether or not the cooling device is abnormal. The control device is configured to acquire a first gas temperature which is a detection value by the temperature sensor when the rotational speed of the electric pump is a first rotational speed, set the rotational speed of the electric pump to a second rotational speed smaller than the first rotational speed after acquiring the first gas temperature, and then acquire a second gas temperature which is a detection value by the temperature sensor, and determine that the cooling device is abnormal if a difference between the first gas temperature and the second gas temperature is less than a threshold value.

According to this configuration, an unsuppressed state (a state where the cooling by the cooling device is not suppressed) and a suppressed state (a state where the cooling by the cooling device is suppressed) are created by suppressing the rotational speed of the electric pump at the second rotational speed lower than the first rotational speed. Thus, the first gas temperature in the unsuppressed state is lower than the second gas temperature in the suppressed state by a value in association with the cooling capacity of the cooling device. In other words, as the cooling capacity of the cooling device becomes lower, the difference between the first gas temperature and the second gas temperature becomes smaller. Therefore, as the difference between the first gas temperature and the second gas temperature is less than the threshold value, it is determined that the cooling device is abnormal. Thus, only by adjusting the rotational speed of the electric pump regardless of the request of the user or the rotational speed of the engine, it is possible to properly determine whether or not an abnormality (a reduction in the cooling capacity of the EGR cooler) is present in the cooling device for cooling the recirculated gas.

(2) Preferably, the second rotational speed is zero.

According to this configuration, it is possible to properly suppress the cooling by the cooling device through a simple process by stopping the rotation of the electric pump so that the rotational speed of the electric pump is zero. Therefore, even in the case where for example an inexpensive electric pump, of which the control accuracy on the rotational speed is not so high, is used, it is still possible to properly determine the abnormality of the cooling device, enabling cost reduction.

(3) Preferably, the control device sets the rotational speed of the electric pump to the second rotational speed after acquiring the first gas temperature, and acquires the second gas temperature after a predefined time has elapsed. The recirculation channel is provided with a recirculation valve for adjusting the flow rate of the exhaust gas flowing in the recirculation channel. The control device adjusts the predefined time on the basis of an opening position of the recirculation valve and a pressure in the intake channel.

According to this configuration, in consideration of the fact that a time needed to make the detection values by the temperature sensor stabilize after setting the rotational speed of the electric pump to the second rotational speed varies in accordance with the flow rate of the recirculated gas, the predefined time can be adjusted to an optimum value on the basis of the opening position of the circulation valve and the pressure in the intake channel that affect the flow rate of the recirculated gas. Therefore, it is possible to suppress the occurrence of such a problem that the predefined time is too short so that the accuracy of abnormality determination is low or the predefined time is too long so that the time required by the abnormality determination is longer than necessary.

(4) Preferably, the control device shortens the predefined time as the flow rate of the recirculated gas in the recirculation channel becomes greater, the flow rate being estimated on the basis of the opening position of the recirculation valve and the pressure in the intake channel.

According to this configuration, in consideration of the fact that a time needed to make the detection values by the temperature sensor stabilize after setting the rotational speed of the electric pump to the second rotational speed shortens as the flow rate of the recirculated gas becomes greater, the predefined time is shortened as the flow rate of the recirculated gas becomes greater. Therefore, the time required for the abnormality determination can be shortened as much as possible without reducing the accuracy of abnormality determination.

(5) Preferably, the control device adjusts the threshold value on the basis of at least one of a rotational speed, a load factor, an ignition timing and a temperature of the engine.

According to this configuration, in consideration of the fact that the difference between the first gas temperature and the second gas temperature varies in accordance with not only the cooling capacity of the cooling device but also the exhaust temperature of the engine, the threshold value can be adjusted to an optimal value on the basis of at least one of the rotational speed, the load factor, the ignition timing and the temperature of the engine that affect the exhaust temperature of the engine. Therefore, it is possible to accurately determine whether an abnormality is present in the cooling device regardless of the exhaust temperature of the engine.

(6) Preferably, the control device increases the threshold value as the exhaust temperature of the engine becomes higher, the exhaust temperature being estimated on the basis of at least one of the rotational speed, the load factor, the ignition timing and the temperature of the engine.

According to this configuration, in consideration of the fact that the difference between the first gas temperature and the second gas temperature increases as the exhaust temperature of the engine becomes higher, the threshold value is increased as the exhaust temperature of the engine becomes higher. Therefore, even if the difference between the first gas temperature and the second gas temperature is increased due to the increase of the exhaust temperature of the engine, the misjudgment of abnormality in the cooling device can be suppressed properly.

Advantageous Effects

According to the present disclosure, it is possible to properly determine whether or not an abnormality (a reduction in the cooling capacity of the EGR cooler) is present in the cooling device for cooling the recirculated gas.

BRIEF DESCRIPTION OF DRAWINGS

Hereinafter, an embodiment of the present invention will be described with reference to the accompanying drawings. In the following description, the same reference numerals are given to the same elements having identical names and functions, and the detailed description thereof will not be repeated.

FIG. 1 is a diagram schematically illustrating a configuration of a vehicle 1 according to the present embodiment. The vehicle, to which the present embodiment is applicable, may be a common engine vehicle or a vehicle capable of traveling on power from an engine and a motor (so-called hybrid vehicle, plug-in hybrid vehicle or the like). The engine is not limited to generating a driving force for vehicle, and may be also used in generating electrical power, for example.

Figure 1:
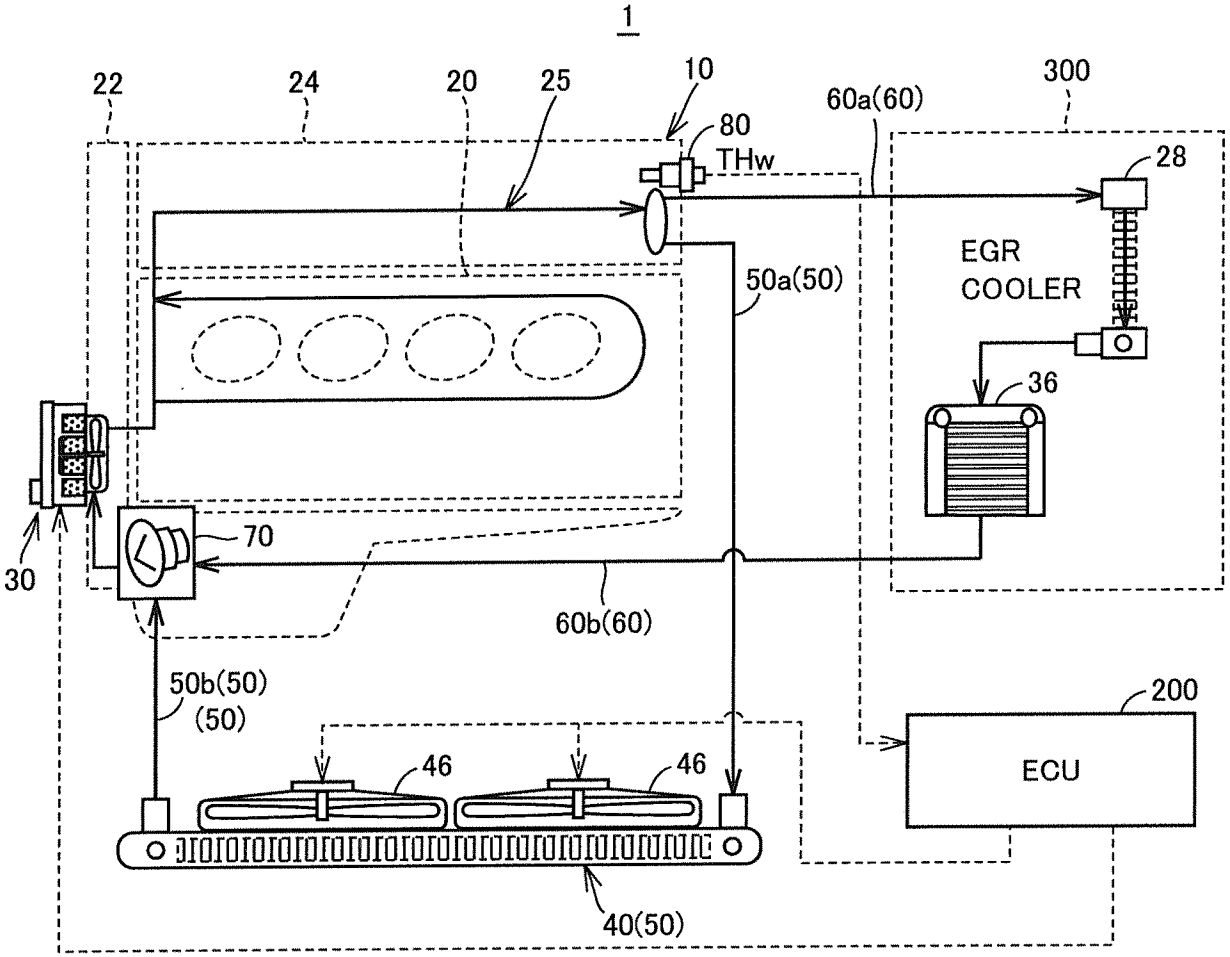
FIG. 1 is a diagram schematically illustrating a configuration of a vehicle.

Vehicle 1 includes an engine 20, an engine cooling device 10 for cooling engine 20, and a control device (hereinafter referred to as "ECU" (Electronic Control Unit)) 200.

Engine cooling device 10 includes an electric water pump (hereinafter referred to as "electric pump") 30, a radiator 40, a radiator circulation channel 50, a bypass channel 60, a thermostat 70, and an engine coolant temperature sensor 80.

Engine 20 is provided with a water jacket 24 for cooling engine 20 by using a coolant. A coolant channel 25 for carrying the coolant is disposed inside water jacket 24. Engine 20 is cooled by the coolant flowing in coolant channel 25.

Electric pump 30 is controlled by a control signal from ECU 200 to circulate the coolant for engine 20.

The coolant flowing through coolant channel 25 is divided and supplied to radiator circulation channel 50 and bypass channel 60.

Radiator circulation channel 50 is a channel for circulating the coolant through radiator 40. Radiator circulation channel 50 is composed of pipes 50*a*, 50*b* and radiator 40. After the coolant warmed by engine 20 passes through radiator circulation channel 50, it is cooled by radiator 40 and is thereafter returned to engine 20. Radiator 40 is provided with a cooling fan 46 controlled by a control signal from ECU 200. Cooling fan 46 blows radiator 40 so as to improve the heat dissipation efficiency.

Bypass channel 60 is a channel for circulating the coolant bypassing radiator 40. Bypass channel 60 includes pipes 60*a*, 60*b* and a heating device 300. Heating device 300 includes an EGR (Exhaust Gas Recirculation) cooler 28 and a heater 36. The other devices (such as a throttle body or the like) may be included in heating device 300.

EGR cooler 28 cools EGR gas (to be described later) by using the coolant flowing in bypass channel 60. Heater 36 is disposed downstream of EGR cooler 28 and configured to warm the passenger compartment by releasing the heat from the coolant into the passenger compartment.

Thermostat 70 is disposed at a joint section where the coolant passed through radiator circulation channel 50 and the coolant passed through bypass channel 60 join together. Thermostat 70 is opened or closed in response to the temperature of the coolant. In the state where thermostat 70 is closed, the coolant to the side of bypass channel 60 can flow back to water jacket 24 through thermostat 70 while the coolant to the side of radiator circulation channel 50 is prevented from flowing back to water jacket 24. On the other hand, in the state where thermostat 70 is opened, both the coolant from radiator circulation channel 50 and the coolant from bypass channel 60 can flow back to water jacket 24 through thermostat 70. The open and close of thermostat 70 in response to the temperature of the coolant keeps the temperature of the coolant in water jacket 24 suitable for engine 20.

Engine coolant temperature sensor 80 detects the temperature of the coolant (hereinafter referred to as "engine coolant temperature THw") flowing near an outlet of coolant channel 25, and transmits the detection result to ECU 200.

Though not shown in the drawings, vehicle 1 is provided with a plurality of sensors for detecting various physical quantities required to control vehicle 1 such as an accelerator pedal position (indicating an amount of an accelerator pedal pressed down by a user) and the rotational speed of engine 20. These sensors are configured to send detection results to ECU 200.

ECU 200 is provided with a CPU (Central Processing Unit) and a memory (both not shown), and is configured to control various devices of vehicle 1 on the basis of information stored in memory and information from each sensor.

Figure 2:
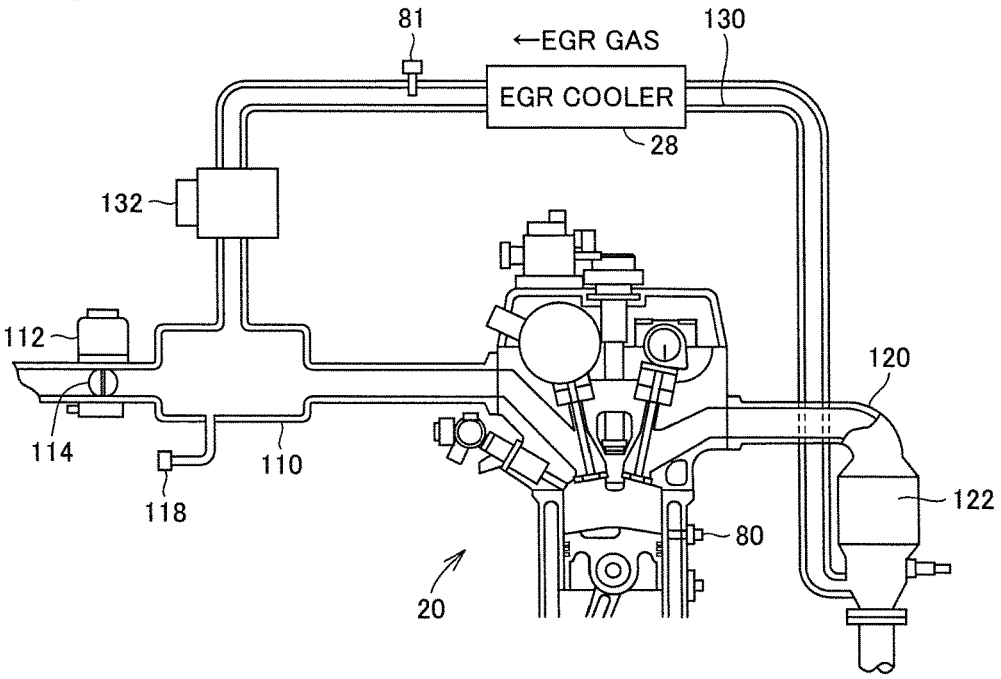
FIG. 2 is a diagram schematically illustrating a configuration of an engine.

FIG. 2 is a diagram schematically illustrating the configuration of engine 20. Engine 20 includes an intake pipe 110, an exhaust pipe 120, and an EGR pipe 130.

In engine 20, after air is filtered by an air cleaner (not shown), it is inhaled into a combustion chamber of engine 20 through intake pipe 110. The amount of air to be inhaled into the combustion chamber of engine 20 through intake pipe 110 (hereinafter referred to as "intake air amount") may be adjusted through the opening position of a throttle valve 114. The opening position of throttle valve 114 is controlled by a throttle motor 112 operating on the basis of a control signal from ECU 200.

An intake air pressure sensor 118 is provided in intake pipe 110 at a location downstream throttle valve 114. The pressure at the downstream of throttle valve 114 in intake pipe 110 is a negative pressure lower than the atmospheric pressure due to the air-intake by engine. Intake air pressure sensor 118 detects the pressure at the downstream of throttle valve 114 in intake pipe 110 (hereinafter referred to as "intake air pressure") and transmits a signal representing the detection result to ECU 200.

Exhaust gas of engine 20 is discharged to the atmosphere through a three-way catalytic converter 122 disposed at any location along an exhaust pipe 120.

EGR pipe 130 is a pipe for recirculating a part of the exhaust gas flowing in exhaust pipe 120 to intake pipe 110. EGR pipe 130 is in communication with the downstream of three-way catalytic converter 122 disposed in exhaust pipe 120 and the downstream of throttle valve 114 disposed in intake pipe 110. The part of the exhaust gas passed through three-way catalytic converter 122 is returned to intake pipe 110 as recirculated gas. Thus, the fuel efficiency can be achieved while suppressing the generation of nitrogen oxides (NOx).

An EGR valve 132 is provided at any location along EGR pipe 130. EGR valve 132 is controlled by a control signal from ECU 200 to regulate the flow rate of the recirculated gas to be returned to intake pipe 110 from EGR pipe 130. In the following, the circulated gas is referred to as "EGR gas", and the flow rate of the recirculated gas is referred to as "EGR flow rate".

ECU 200 determines a desired EGR flow rate based on a load (intake air amount) and a rotational speed of engine 20, and adjusts the opening position of EGR valve 132 (hereinafter referred to as "EGR opening position") so as to make an actual EGR flow rate equal to the desired EGR flow rate. It is also possible to adjust the EGR opening position by using an EGR rate which is defined as (EGR flow rate/(intake air amount +EGR flow rate)) as an index of the EGR flow rate.

EGR cooler 28 described above with reference to FIG. 1 is provided at a location upstream EGR valve 132 in EGR pipe 130. EGR cooler 28 contacts EGR pipe 130, and cools the EGR gas inside EGR pipe 130 by using the coolant supplied from electric pump 30. Accordingly, since the EGR gas is prevented from being recirculated to intake pipe 110 at a high temperature, the deterioration of intake pipe 110 and the peripheral components (such as EGR valve 132 and the like) due to overheating is suppressed.

A gas temperature sensor 81 is provided in EGR pipe 130 at a location downstream of EGR cooler 28. Gas temperature sensor 81 detects the temperature of the EGR gas at the downstream of EGR cooler 28 (i.e., after being cooled by EGR cooler 28), and transmits the detection result to ECU 200.

In vehicle 1 having the abovementioned configuration, if the cooling capacity of EGR cooler 28 is decreased, the EGR gas will be recirculated to intake pipe 110 while being hot. As a result, intake pipe 110 and the peripheral components may be damaged due to overheating, abnormal combustion (knocking) may occur due to an increase of the intake air temperature or a decrease of the EGR gas density, and the effect of improving the fuel economy may be decreased. Therefore, it is desired to detect a reduction in the cooling capacity of EGR cooler 28 and notify the same to the user.

Therefore, ECU 200 according to this embodiment varies the amount of coolant supplied to EGR cooler 28 by reducing temporarily the rotational speed of electric pump 30 lower than normal, and then determines whether or not an abnormality (a reduction in cooling capacity) is present in EGR cooler 28 on the basis of a variation amount detected by gas temperature sensor 81 at that moment.

Figure 3:
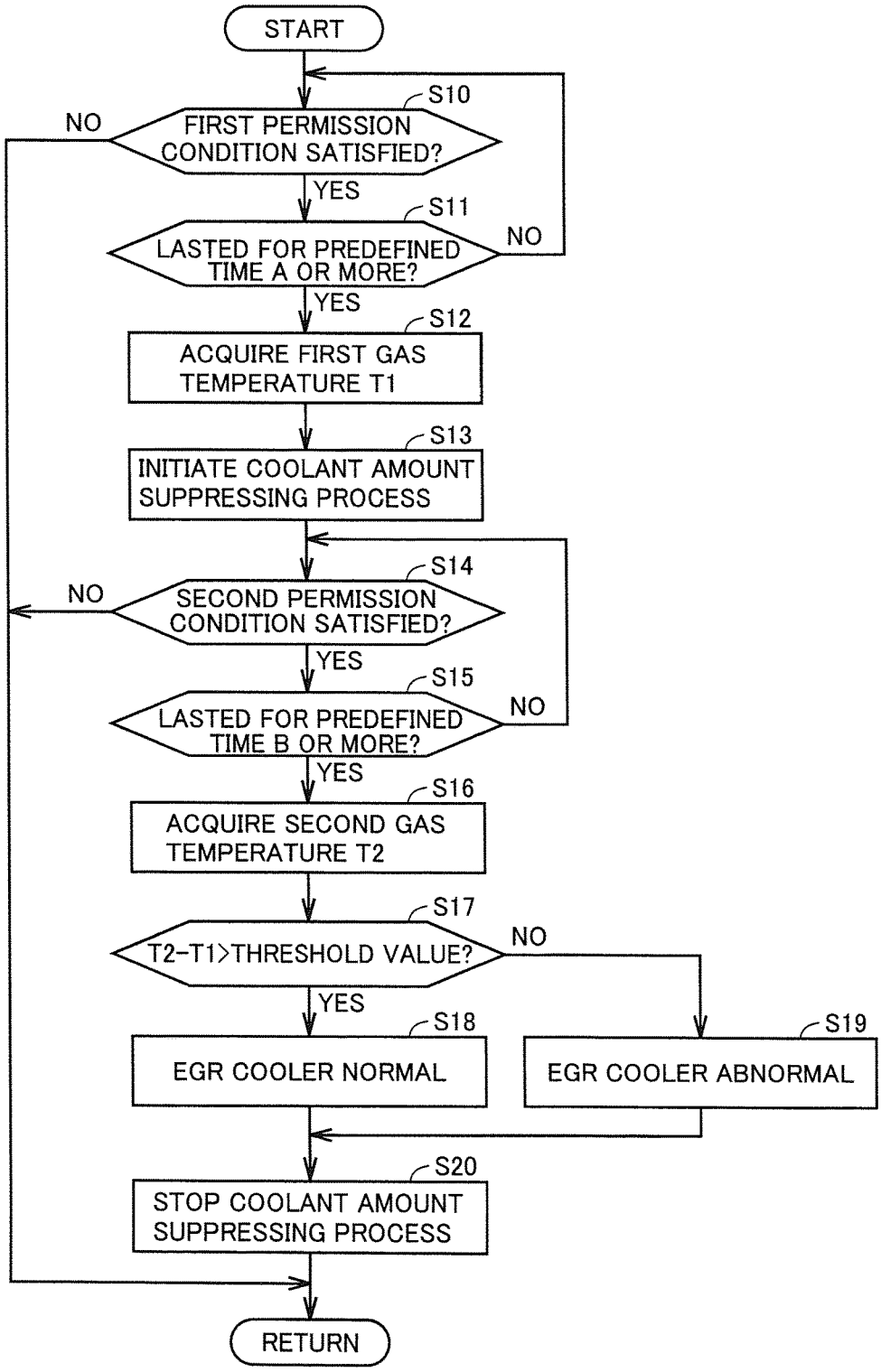
FIG. 3 is a flow chart illustrating a process executed by an ECU.

FIG. 3 is a flowchart illustrating a process executed by ECU 200 in determining the presence of a reduction in cooling capacity of EGR cooler 28.

At steps (hereinafter, step will be abbreviated as "S") 10 and 11, ECU 200 determines whether a detection value detected by gas temperature sensor 81 when electric pump 30 is rotating at a rotational speed within a predefined range is stable or not.

Specifically, firstly at S10, ECU 200 determines whether or not a first permission condition is satisfied. For example, if the following conditions (a) to (c) are all satisfied, ECU 200 determines that the first permission condition is satisfied.

(a) the desired EGR flow rate (or the desired EGR rate) is not less than a predefined value.

(b) electric pump 30 is rotating at a rotational speed within a predefined range.

(c) the warm-up of engine 20 has been completed.

Condition (a) is a condition to ensure that the EGR flow rate is sufficient for stabilizing the detection value by gas temperature sensor 81. Condition (b) is a condition to ensure the supply of coolant to EGR cooler 28 is performed as stable as normal. Condition (c) is a condition to ensure that engine 20 is sufficiently warmed up and the temperature of each component is stable.

On the other hand, for example, it is acceptable that ECU 200 may determine that the first permission condition is not satisfied if at least one of the following conditions (d) to (f) is true, despite that whether the conditions (a) to (c) are satisfied or not.

(d) the engine coolant temperature THw is beyond a predefined range.

(e) the engine intake air temperature is beyond a predefined range.

(f) the operating state (the rotational speed, the load factor or the like) of engine 20 has changed abruptly.

Conditions (d) and (e) are conditions to prevent the cooling capacity (heat exchange efficiency) of EGR cooler 28 from becoming unstable due to the reasons that engine 20 is overheated or overcooled. Condition (f) is a condition to prevent the exhaust temperature of engine 20 from changing abruptly and becoming unstable.

If the first permission condition is not satisfied (NO at S10), ECU 200 terminates the process.

If the first permission condition is satisfied (YES at S10), at S11, ECU 200 determines whether or not the satisfaction state of the first permission condition has lasted for a predefined time A or more. The predefined time A is set to a value capable of ensuring that the detection value by gas temperature sensor 81 is sufficiently stable while the first permission condition is being satisfied.

If the satisfaction state of the first permission condition has not lasted for the predefined time A or more (NO at S11), ECU 200 returns the process to step S10.

If the satisfaction state of the first permission condition has lasted for the predefined time A or more (YES in S11), in other words, in a state where the cooling is performed stably as normal without being suppressed (hereinafter referred to as "normally stable state"), at S12, ECU 200 acquires the detection value by gas temperature sensor 81 and stores it as a "first gas temperature T1".

Then, at S13, ECU 200 initiates a process of suppressing the amount of coolant supplied to EGR cooler 28 to a predefined amount (hereinafter referred to as "coolant amount suppressing process") by reducing the rotational speed of electric pump 30 lower than that in the normally stable state by a predefined rotational speed.

Then, at S14 and S15, ECU 200 determines whether or not the detection value by gas temperature sensor 81 is stable in the state where the coolant amount suppressing process is being performed (i.e., a state where the cooling by EGR cooler 28 is being suppressed).

Specifically, at S14, ECU 200 firstly determines whether or not a second permission condition is satisfied. In the present embodiment, the second permission condition is configured to include condition (a) included in the first permission condition described above, that is, "the desired EGR flow rate (or the desired EGR rate) is not less than a predefined value". It is acceptable that the second permission condition may include a plurality of the other conditions included in the first permission condition described above excluding condition (b).

If the second permission condition is not satisfied (NO at S14), since the EGR flow rate is not ensured sufficient for stabilizing the detection value by gas temperature sensor 81, ECU 200 terminates the process.

If the second permission condition is satisfied (YES at 514), at S15, ECU 200 determines whether or not the satisfaction state of the second permission condition has lasted for a predefined time B or more. The predefined time B is set to an optimal value in consideration of the time needed to make the detection value by gas temperature sensor 81 stabilize after the start of the coolant amount suppressing process (in other words, after the rotational speed of electric pump 30 is set lower than the rotational speed in the normally stable state). Specifically, if the specified time B is too short, the process subsequent to S16 will be performed while the detection value by gas temperature sensor 81 is not stable yet. On the other hand, if the predefined time B is too long, the process subsequent to S16 will not be performed even though the detection value by gas temperature sensor 81 has already been stable, making the process longer than necessary. In order to prevent these problems from occurring, the predefined time period B is set to an optimal time (a fixed value) through experiments or the like in consideration of the heat capacity of EGR pipe 130 from EGR cooler 28 to gas temperature sensor 81. Note that if the heat capacity of EGR pipe 130 from EGR cooler 28 to gas temperature sensor 81 is larger, the time required to stabilize gas temperature sensor 81 will be longer, and thereby, the predefined time B will become longer.

If the satisfaction state of the second permission condition is not lasted for the predefined time B or more (NO at S15), ECU 200 returns the process to step S14.

If the satisfaction state of the second permission condition has lasted for the predefined time B or more (YES in S15), in other words, in a state where the detection value by gas temperature sensor 81 is stable while the cooling by EGR cooler 28 is being suppressed by the coolant amount suppressing process (hereinafter referred to as "suppressed stable state"), at S16, ECU 200 acquires the detection value by gas temperature sensor 81 as a "second gas temperature T2".

At S17, ECU 200 determines whether or not the value obtained by subtracting first gas temperature T1 from second gas temperature T2 is greater than a threshold value. The threshold is a value for determining whether or not EGR cooler 28 is abnormal, and is set to an optimum value (fixed value) obtained through experiments or the like.

If the value obtained by subtracting first gas temperature T1 from second gas temperature T2 is greater than the threshold value (YES at S17), at S18, ECU 200 determines that EGR cooler 28 is normal (i.e., the cooling capacity of EGR cooler 28 is not decreased).

If the value obtained by subtracting first gas temperature T1 from second gas temperature T2 is less than the threshold value (NO at S17), at S19, ECU 200 determines that EGR cooler 28 is abnormal (i.e., the cooling capacity of EGR cooler 28 is decreased). In the case where EGR cooler 28 is determined to be abnormal, the user is notified by means of a device (not shown).

At S20, ECU 200 stops the coolant amount suppressing process.

Figure 4:
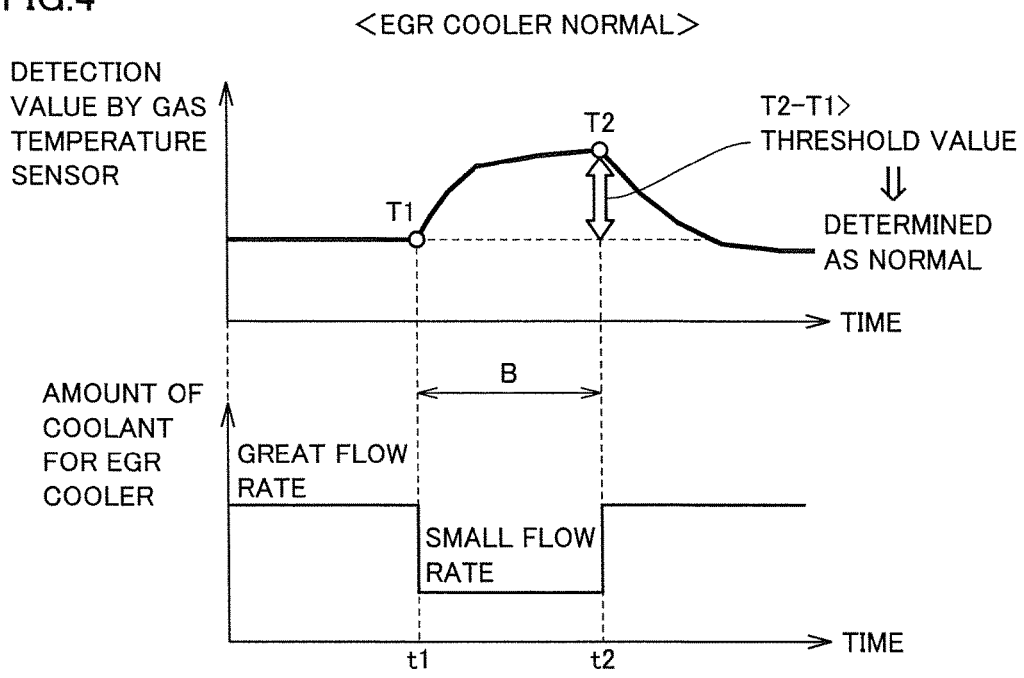
FIG. 4 is a diagram schematically illustrating a change of detection values by a gas temperature sensor when an EGR cooler is determined to be normal.

FIG. 4 is a diagram schematically illustrating a change of detection values by gas temperature sensor 81 when EGR cooler 28 is determined to be normal.

After first gas temperature T1 is acquired at a timing t1 in the normally stable state, the coolant amount suppressing process is started, and the rotational speed of electric pump 30 is decreased lower than that in the normal stable state by a predefined rotational speed. Thereby, the amount of coolant supplied to EGR cooler 28 is decreased, leading to the suppression of the cooling by EGR cooler 28, and as a result, the EGR gas temperature will increase gradually.

Then, after second gas temperature T2 is obtained at a timing t2 where the suppressed stable state has lasted for the predefined time B from the start of the coolant amount suppressing process, the coolant amount suppressing process is stopped.

Here, first gas temperature T1 in the normally stable state is lower than the EGR gas temperature upstream of EGR cooler 28 by a temperature in association with the cooling capacity of EGR cooler 28. On the other hand, due to the reason that the cooling by EGR cooler 28 is suppressed, second gas temperature T2 in the suppressed stable state is substantially equal to the EGR gas temperature upstream of EGR cooler 28. Therefore, as illustrated in FIG. 4, if EGR cooler 28 is normal, the difference between first gas temperature T1 and second gas temperature T2 is greater than the threshold value. Accordingly, the EGR cooler is determined to be "normal".

Figure 5:
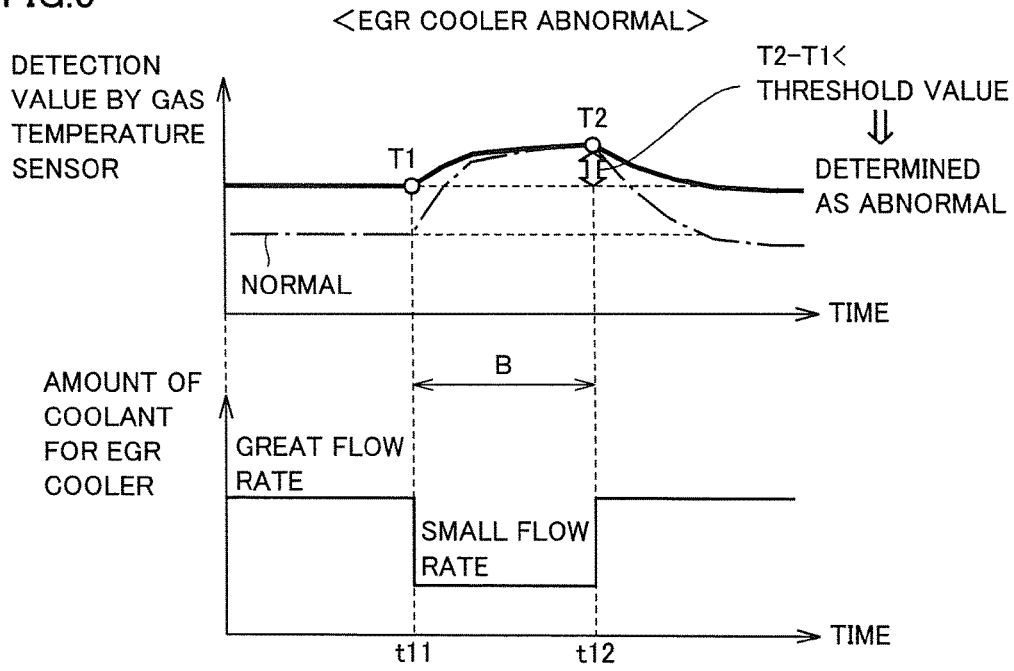
FIG. 5 is a diagram schematically illustrating a change of detection values by the gas temperature sensor when the EGR cooler is determined to be abnormal.

FIG. 5 is a diagram schematically illustrating a change of detection values by gas temperature sensor 81 when EGR cooler 28 is determined to be abnormal.

Similar to FIG. 4 described above, first gas temperature T1 is acquired at a timing t11 in the normally stable state, and second gas temperature T2 is obtained at a timing t12 where the suppressed stable state has lasted for the predefined time B from the start of the coolant amount suppressing process.

When EGR cooler 28 is abnormal, first gas temperature T1 in the normally stable state is higher than the temperature when the EGR cooler is normal (see dashed line). On the other hand, second gas temperature T2 in the suppressed stable state is not affected by EGR cooler 28 when it is abnormal since the cooling by EGR cooler 28 is suppressed from the very beginning and thereby has a value substantially equal to that when the EGR cooler is normal. Thus, when EGR cooler 28 is abnormal, compared to the normal state, the difference between first gas temperature T1 and second gas temperature T2 becomes smaller. Thereby, the difference between first gas temperature T1 and second gas temperature T2 becomes smaller than the threshold value. Accordingly, the EGR cooler is determined to be "abnormal".

As described above, ECU 200 according to the present embodiment creates a coolant amount unsuppressed state (a state where the cooling of the EGR gas by EGR cooler 28 is not suppressed) and a coolant amount suppressed state (a state where the cooling of the EGR gas by EGR cooler 28 is suppressed) by suppressing the rotational speed of electric pump 30 lower than the rotational speed in the normally stable state through the coolant amount suppressing process. Thus, first gas temperature T1 in the coolant amount unsuppressed state is lower than second gas temperature T2 in the coolant amount suppressed state only by a value in association with the cooling capacity of EGR cooler 28. In other words, as the cooling capacity of EGR cooler 28 becomes lower, the difference between first gas temperature T1 and second gas temperature T2 becomes smaller. Therefore, in the case where the difference between first gas temperature T1 and second gas temperature T2 is less than the threshold value, ECU 200 determines that EGR cooler 28 is abnormal. Thereby, only by adjusting the rotational speed of the electric pump regardless of the request of the user or the rotational speed of the engine, it is possible to properly determine whether or not an abnormality is present in EGR cooler 28.

Modification 1

In the above embodiment, as the coolant amount suppressing process, the rotational speed of electric pump 30 is decreased lower than that in the normally stable state by a predefined rotational speed, and it is acceptable to stop the rotation of electric pump 30.

According to the present modification, it is possible to properly suppress the cooling of the EGR gas by EGR cooler 28 through a simple process by stopping the rotation of electric pump 30 so that the rotational speed of electric pump 30 is zero. Therefore, even in the case where for example an inexpensive electric pump, of which the control accuracy on the rotational speed is not so high, is used, it is still possible to properly determine the abnormality of EGR cooler 28, enabling cost reduction.

Modification 2

In the above embodiment, though the predefined time B during which the coolant amount suppressing process is lasted is set to a fixed value, it is acceptable to adjust the predefined time B on the basis of the EGR opening position and the intake air pressure.

According to the present modification, in consideration of the fact that the time needed to make the detection values by gas temperature sensor 81 stabilize after setting the rotational speed of the electric pump to the second rotational speed varies in accordance with the flow rate of the recirculated gas, the predefined time B can be adjusted to an optimum value on the basis of the EGR opening position and the intake air pressure. Therefore, it is possible to suppress occurrence of such a problems that the predefined time B is too short so that the accuracy of abnormality determination of EGR cooler 28 is low or the predefined time B is too long so that the time required by the abnormality determination of EGR cooler 28 is longer than necessary.

Furthermore, it is acceptable to shorten the predefined time B as the EGR flow rate estimated on the basis of the EGR opening position and the intake air pressure becomes greater.

According to the present modification, in consideration of the fact that the time needed to make the detection values by gas temperature sensor 81 stabilize after the start of the coolant amount suppressing process shortens as the EGR flow rate becomes greater, the predefined time B can be shortened as the EGR flow rate becomes greater. Therefore, the time required by the abnormality determination of EGR cooler 28 can be shortened as much as possible without reducing the accuracy of abnormality determination of EGR cooler 28.

Modification 3

In the embodiment described above, the threshold value for determining whether or not EGR cooler 28 is abnormal is set to a fixed value. However, it is acceptable to adjust the threshold value on the basis of the state of engine 20 (at least one of the rotational speed, the load factor, the ignition timing, the temperature (the engine coolant temperature THw)).

According to the present modification, in consideration of the fact that the difference between first gas temperature T1 and second gas temperature T2 varies in accordance with not only the cooling capacity of EGR cooler 28 but also the exhaust temperature of engine 20, the threshold value can be adjusted to an optimal value on the basis of the state of engine 20 (at least one of the rotational speed, the load factor, the ignition timing and the temperature) that affects the exhaust temperature of engine 20. Therefore, it is possible to accurately determine whether or not an abnormality is present in EGR cooler 28 regardless of the exhaust temperature of engine 20.

Furthermore, it is acceptable to estimate the exhaust temperature of engine 20 on the basis of the state of engine 20 (at least one of the rotational speed, the load factor, the ignition timing and the temperature) and increase the threshold value as the estimated exhaust temperature of engine 20 becomes higher.

According to the present modification, in consideration of the fact that the difference between first gas temperature T1 and second gas temperature T2 increases as the exhaust temperature of engine 20 becomes higher, the threshold value can be set greater as the exhaust temperature of engine 20 becomes higher. Therefore, even if the difference between first gas temperature T1 and second gas temperature T2 is increased due to the increase of the exhaust temperature of engine 20, the misjudgment of abnormality in EGR cooler 28 can be suppressed properly.

It should be understood that the embodiments disclosed herein have been presented for the purpose of illustration and description but not limited in all aspects. It is intended that the scope of the present invention is not limited to the description above but defined by the scope of the claims and encompasses all modifications equivalent in meaning and scope to the claims.

REFERENCE SIGNS LIST

1: vehicle; 10: engine cooling device; 20: engine; 24: water jacket; 25: coolant channel; 28: EGR cooler; 30: electric pump; 36: heater; 40: radiator; 46: cooling fan; 50: radiator circulation channel; 50*a*, 50*b*, 60*a*, 60*b*: pipe; 60: bypass channel; 70: thermostat; 80: engine coolant temperature sensor; 81: gas temperature sensor; 110: intake pipe; 112: throttle motor; 114: throttle valve; 118: intake air pressure sensor; 120: exhaust pipe; 122: three-way catalytic converter; 130: EGR pipe; 132: EGR valve; 200: ECU; 300: heating device

What is claimed is:

1. A vehicle provided with an engine having a recirculation channel for recirculating a part of exhaust gas flowing in an exhaust channel to an intake channel, the vehicle comprising:

a cooler, in contact with the recirculation channel, configured to cool a recirculated gas in the recirculation channel by a coolant;

an electric pump configured to supply the coolant to the cooler;

a temperature sensor configured to detect a temperature of the recirculated gas in the recirculation channel at a downstream of the cooler; and an electronic control unit configured to determine whether or not an abnormality is present in the cooler, the electronic control unit being configured to acquire a first gas temperature detected by the temperature sensor when a rotational speed of the electric pump is a first rotational speed, the electronic control unit being configured to set the rotational speed of the electric pump to a second rotational speed smaller than the first rotational speed after acquiring the first gas temperature, and then acquire a second gas temperature detected by the temperature sensor, and the electronic control unit being configured to determine that the cooler is abnormal if a difference between the first gas temperature and the second gas temperature is less than a threshold value.

2. The vehicle according to claim 1, wherein the second rotational speed is zero.

3. The vehicle according to claim 1, wherein the electronic control unit is configured to set the rotational speed of the electric pump to the second rotational speed after acquiring the first gas temperature, and acquire the second gas temperature after a predefined time has elapsed, the recirculation channel is provided with a recirculation valve, the recirculation valve is configured to adjust a flow rate of the exhaust gas flowing in the recirculation channel, and the electronic control unit is configured to adjust the predefined time based on an opening position of the recirculation valve and a pressure in the intake channel.

4. The vehicle according to claim 3, wherein the electronic control unit is configured to shorten the predefined time as the flow rate of the recirculated gas in the recirculation channel becomes greater, the flow rate being estimated based on the opening position of the recirculation valve and the pressure in the intake channel.

5. The vehicle according to claim 1, wherein the electronic control unit is configured to adjust the threshold value based on at least one of a rotational speed, a load factor, an ignition timing and a temperature of the engine.

6. The vehicle according to claim 5, wherein the electronic control unit is configured to increase the threshold value as an exhaust temperature of the engine becomes higher, the exhaust temperature being estimated based on at least one of the rotational speed, the load factor, the ignition timing and the temperature of the engine.

* * * * *